United States Patent [19]

Krautzberger

[11] Patent Number: 4,850,406

[45] Date of Patent: Jul. 25, 1989

[54] CYLINDRICAL CUTTER HEAD

[75] Inventor: Dieter Krautzberger, Kreuznach, Fed. Rep. of Germany

[73] Assignee: Babcock BSH Aktiengesellschaft vormals Büttner-Schilde-Haas AG, Krefeld, Fed. Rep. of Germany

[21] Appl. No.: 296,871

[22] Filed: Jan. 12, 1989

Related U.S. Application Data

[63] Continuation of Ser. No. 115,008, Oct. 28, 1987, abandoned.

[30] Foreign Application Priority Data

Oct. 28, 1986 [DE] Fed. Rep. of Germany ..... 3636618

[51] Int. Cl.[4] ..... B27G 13/04; B26D 1/12

[52] U.S. Cl. ..... 144/230; 144/174; 407/49

[58] Field of Search ..... 144/174

[56] References Cited

U.S. PATENT DOCUMENTS

| | | | |
|---|---|---|---|
| 3,014,511 | 12/1961 | Kirsten | 144/230 |
| 3,854,511 | 12/1974 | Maier | 144/230 |
| 3,957,094 | 5/1976 | Maier | 144/230 |
| 3,989,077 | 11/1976 | Humbert | 144/230 |
| 4,068,694 | 1/1978 | Schmidt et al. | 144/230 |
| 4,194,545 | 3/1980 | Kostermeier | 144/230 |

FOREIGN PATENT DOCUMENTS

| | | | |
|---|---|---|---|
| 254871 | 1/1949 | Switzerland | 144/230 |

*Primary Examiner*—W. Donald Bray
*Attorney, Agent, or Firm*—Herbert Dubno

[57] ABSTRACT

A cylindrical cutter head for a wood planing machine has mounted in its circumference a number of disposable knife blades which are clamped in place with the help of centrifugal wedges in lengthwise grooves. Between each disposable knife blade and each centrifugal wedge there is positioned a bracket of L-shaped profile consisting of a base strip which is immovably attached to the cutter head body and a clamping strip bearing against the knife blade, this clamping strip being elastically deformable to a small extent. By means of a conformal relation of a profiled region of the disposable knife blade with a corresponding profiled region of the clamping strip, the disposable knife blade is held firmly in position when clamped in. After loosening of the centrifugal wedge, the disposable knife blade can be easily withdrawn in a lengthwise direction and can be replaced with accurate positioning.

9 Claims, 2 Drawing Sheets

CYLINDRICAL CUTTER HEAD

This is a continuation of co-pending application Ser. No. 115,008 filed on Oct. 28, 1987, abandoned.

FIELD OF THE INVENTION

My invention relates to a cutter head for a wood working machine, in particular, a rotating cylindrical cutter head for a planing machine which has knife blades mounted in the cutter head parallel to its axis.

BACKGROUND OF THE INVENTION

For some years, it has been a known practice in the design of wood working machines of the indicated type to use inexpensive disposable knife blade inserts, so as to avoid the time-consuming task of resharpening the blades. In accordance with German Patent Application No. 25 59 406, which is relevant in a broad and general way to the approach taken in the present invention, it is already known to use profiled disposable knife blades, which are clamped into profiled mounting receptacles and held by means of a groove and conformable spring clamping arrangement, thus being more precisely positionable and more easily exchangeable than the previously-known perforated disposable knife blades.

In accordance with the aforementioned German application, a centrifugal wedge is positioned in the knife blade mounting groove with one gripping surface against the side wall of the groove and the other wedge surface against a retaining strip. Against the back side of the disposable knife blade there is a clamping strip which is flush against the other side wall of the groove. The centrifugal wedge, whose wedge angle obviously must be such that it does not spontaneously jam in the groove, is pressed in an outward direction by a spring.

For purposes of rapid changing of the knife blade, the retaining strip is movable in a diagonal direction with respect to the cylindrical cutter head, against spring pressure as shown in a working example. In order to change the knife blade and to adjust the new blade, it would seem that various means are needed. Since the positioning of the knife blade depends on the exact fitting together of several interpenetrating parts, small deviations from the correct positions can be cumulative. This type of inaccuracy is perhaps tolerable in certain kinds of wood working machines having cutting blades in accordance with Ger. Appl. No. 25 59 406. However, planing machines make much greater demands for precision.

European Patent No. A1-0 117 991 describes a cutter head for planing machines which likewise has disposable knife blades mounted in it. Each knife blade sits in a groove and is gripped by means of a self-locking centrifugal wedge which, in the sense of the rotational direction, lies directly on the knife blade. The profiling of the knife blade fits conformably with a corresponding profiling of the side wall of the groove. With this arrangement of the cutter head, after loosening the centrifugal wedge, the knife blades can be withdrawn lengthwise or inserted lengthwise by way of the end face of the cylindrical cutter head. The exact positioning takes place automatically as the result of the interlocking of the profiled surfaces. By these means, the changing of the knife blades is made very simple and can be carried out by unskilled personnel in a short time. These advantages are achieved, however, at the cost of a disadvantage. Unfortunately, the design of the groove is so complicated that it is not possible to make the cutter head body out of a single piece. Therefore, the cutter head body must be built up out of stamped sheets, which are arranged side by side on an axial tube and clamped between two end plates. This mode of construction using lamellae causes dimensional inaccuracy, further aggravated by reduced resistance to bending and by recurring imbalance problems. These problems can influence the surface quality of the workpiece, depending on the type of wood being worked on. Therefore, the range o usefulness of this type of machine is limited. A further disadvantage of the lamellar construction is the danger of crevice corrosion. Depending on the arrangement of the centrifugal wedge behind the knife blade, the critical cross-sectional area behind the centrifugal wedge is very small and this tends to cause a so-called bending up or tilting up effect.

Other methods devised to clamp knife blades in rotating cutting heads have been devised using a multiplicity of additional parts, as exemplified in German Patent Applications No. 29 16 138, 30 18 359, 32 09 445, 34 12 251, German Pat. No. 34 37 688, and European patent Appl. No. 0 065 496. In general these are disadvantageously complex in their construction, requiring various positioning screws, closely fitting rigid clamps, springs, and other disadvantageous features. As stated, the more parts the more cost in manufacture, the more care and skill needed in removing and replacing the knife blades, and the more opportunity for problems of positional inaccuracy, crevice corrosion, dirt accumulation, and freezing up or troublesome binding of the parts.

OBJECTS OF THE INVENTION

An object of my invention is to provide a cutter head for wood planing machines which allows trouble-free changing of the knife blades. A further object is to provide such a cutter head which can satisfy requirements for high precision without necessitating a high degree of skill and care in knife blade positioning.

A further object is to provide a cutter head which is simple to manufacture, having few parts and having only parts of easily manufactured configuration.

SUMMARY OF THE INVENTION

The aforementioned objectives are achieved by having the cutter head comprise a cylindrical cutter head body having in its surface a number of grooves parallel to the axis and narrowing toward the surface of the cutter head body, a profiled disposable knife blade being clamped in each of these grooves, a centrifugal wedge being positioned in each of these grooves so as to provide clamping means for the knife blade, a holding bracket being interposed between the knife blade and the centrifugal wedge, the profiling of the knife blade fitting conformably into a corresponding profiling of the side surface of the bracket, and with the improvement that the holding bracket is immovably attached to the cutter head body and is elastically deformable.

According to one advantageous feature of my invention, the face of the disposable knife blade away from the bracket lies flush with the side wall of the groove.

According to another advantageous feature of my invention, the bracket is arranged, in the direction of motion, in front of the disposable knife blade.

Another advantageous feature has the holding bracket including its base strip constituted by a single L-cross-section profile, wherein the base strip is attached by screws to the base of the groove.

Another advantageous feature is that in which the centrifugal wedge is self-seating.

Another advantageous feature of the invention is that in which the centrifugal Wedge is supportable away from the floor of the groove by means of positioning screws.

Still another advantageous feature of the invention is that in which the centrifugal wedge is made of a light metal such as aluminum.

BRIEF DESCRIPTION OF THE DRAWINGS

The above and other objects, features, and advantages of my invention will become more readily apparent from the following description, reference being made to the accompanying highly-diagrammatic drawing in which.

DETAILED DESCRIPTION

Figure 1:
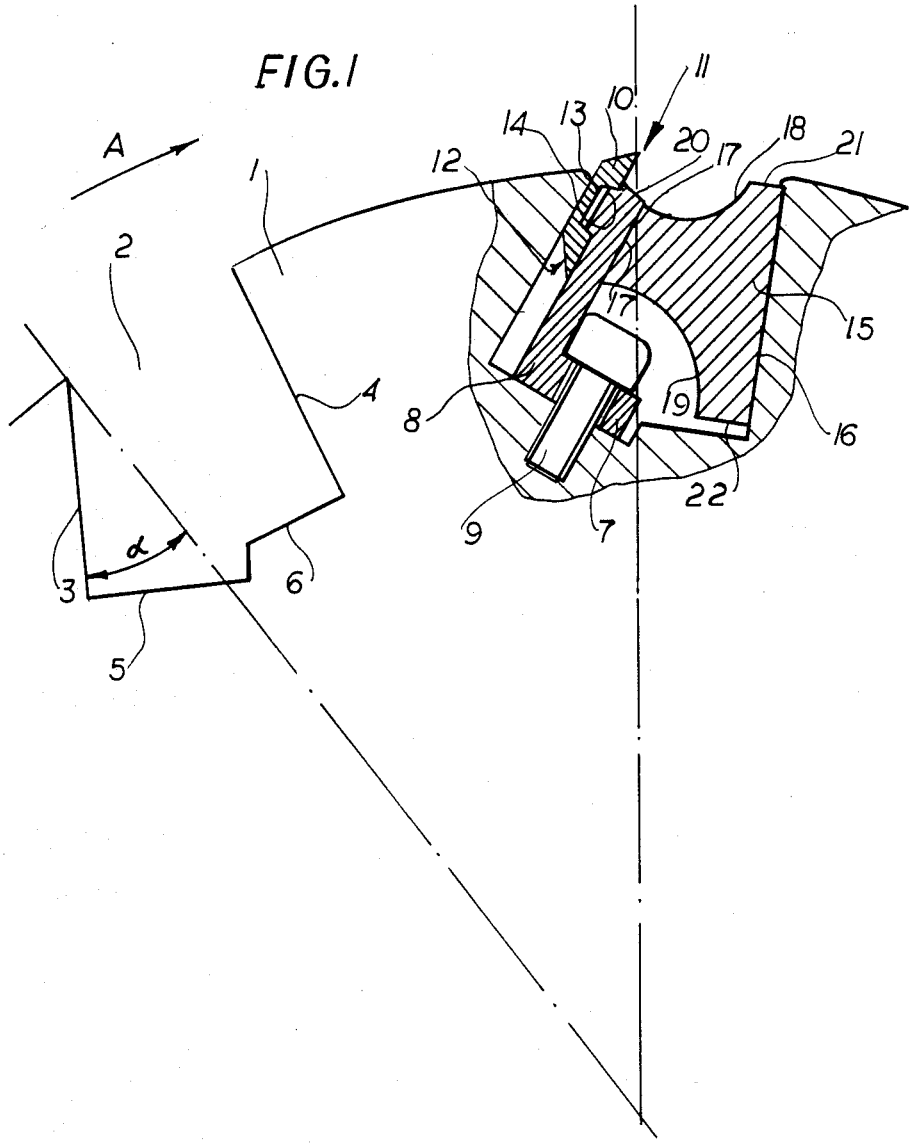
FIG. 1 is a side view cross-section of the relevant grooved portion of the cutter head according to the invention.

In reference to FIG. 1, in the cylindrical outer surface of a cutter head 1, made of a massive material, there are several grooves 2 parallel to the axis of the cylindrical cutter head and at equal angular distance from one another. These grooves narrow toward the cutter head surface. One side wall 3 of the groove 2 forms an angle A of about 30 degrees with respect to the relevant radius of the cutter head. This side wall is hereinafter called the trailing wall because it is the later wall encountered as the cutter head rotates in the direction indicated by the arrow A in the Figure. The other side wall 4, the leading wall, is positioned radially or approximately radially. The floor of the groove consists of two strips 5 and 6 of approximately equal breadth, related in a steplike way to one another; strip 5 makes a right angle with wall 3 and strip 6 makes a right angle with wall 4.

Along the entire length of groove 2 there is positioned a steel bracket having an L-shaped cross section and with well finished flat surfaces, consisting of a base strip 7 and a clamping strip 8. The base strip 7 is immovably attached to the strip 5 of the groove, which is at a right angle to the farther wall 3. The screws 9 are secured with adhesive. The base strip 7 is only as broad as necessary to permit the attachment of the screws 9. It is relatively thick, its thickness being about half its breadth. Therefore, it is practically undistortable. The clamping strip 8 has its surface parallel to the trailing wall 3 and extends above the full height of the latter up to the surface of the cutter head body 1. It is essentially broader than the base strip 7 and about half as thick. It is therefore elastically deformable under strong force, although it has rather high bending modulus.

In the small crevice between the farther wall 3 and the clamping strip 8 a disposable knife blade 10 is clamped. This knife blade, as is usual, is shaped as a reversible knife blade with two cutting edges 11 and 12. The one cutting edge 11 stands a little distance away from the cylindrical surface of the cutter head 1. The other cutting edge 12 which is held in reserve is positioned approximately in the middle of the clamping strip 8 of the bracket which comprises strips 7 and 8.

The disposable knife blade 10 has on its side abutting the clamping strip a groove 13. The surface of the clamping strip 8 which abuts the knife blade is provided with a key strip 14 having its breadth corresponding to the groove 13. The back side of the disposable knife blade 10 which abuts the farther wall 3 is completely smooth.

In the wedge-shaped space between the clamping strip 8 and the nearer wall 14 is positioned conformably a centrifugal wedge 15 with gripping surfaces 16 and 17. The gripping surface 16 is broad and thus lies against nearly the entire height of the leading wall. The other gripping surface 17 is small and lies against the near side of the clamping strip 8 only in apposition to the disposable knife blade 10. The foreshortening of the gripping surface 17 is effected by means of two arc-shaped excisions 18 and 19 cut out of the corners. The one excision 18, which terminates flush with the angular small surface 20 of the clamping strip 8, forms a chip pocket in front of the Cutting edge 11. The other excision 19 is required because of the screws 9. Beside both excisions there are provided relatively small platforms 21 and 22. The outer platform 21 is nearly flush with the outer surface of the cutter head 1 when the wedge is in the pressure-loaded position. The inner platform 22 lies at a small distance parallel to the floor strip 6 of the groove. The centrifugal wedge can consist of steel, but also can be made of light metal, such as aluminum, magnesium or a light alloy if a more moderate pressure is desired.

For switching the disposable knife blade 10 it is necessary first to loosen the centrifugal wedge 15 by applying force against the platform 21. The clamping strip 8, which in the pressured position has been slightly deformed toward the disposable knife blade, returns to its unpressured position.

Thereby, the seat of the knife blade is loosened and the knife blade may then easily be withdrawn in the direction of the cutter head end face.

Subsequently, a new knife blade can be inserted lengthwise from the end face of the cutter head. As soon as the cutter head reaches rapid rotation, the centrifugal wedge 15 is pressed into place by centrifugal force. Since the centrifugal wedge is formed in a self-blocking configuration, it remains in the pressed-in-place position even after the cutter head comes to a halt.

Figure 2:
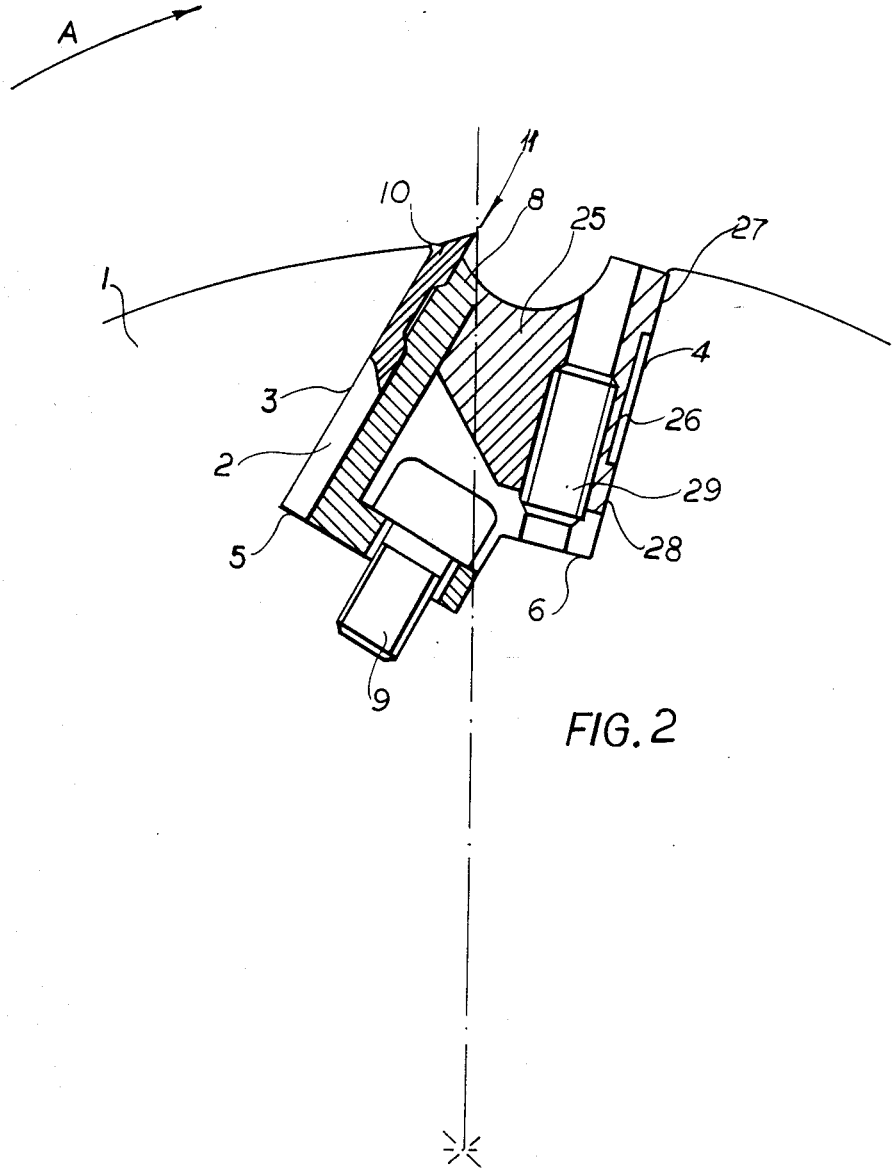
FIG. 2 is a side view cross-section of the grooved portion of the cutter head according to a particular advantageous feature of the invention.

In the embodiment illustrated in FIG. 2, the pressure surface of a centrifugal wedge 25 which impinges on the forward wall 4 of the groove 2 is provided with a broad lengthwise groove 26, so that only the marginal zones 27 and 28 impinge. Thereby, a better defined position is achieved. In the centrifugal wedge 25 there are several positioning screws 29 oriented radially and distributed over the length of the wedge, which rest against the floor of the groove. With the help of the screws 29, even in the resting position of the cutter head, a certain pre-pressuring can be brought about.

There are a few other minor differences between the embodiments in FIGS. 1 and 2. One of these differences is that the side walls of the conformal profiling of the knife blade and clamping strip are at an angle away from 90 degrees. This has advantages such as reducing the accumulation of dirt, lessening the risk of binding, and increasing the precision of knife positioning.

All of the novel features, individually and in combination, which are disclosed in the discussion or in the FIGURES are contemplated as being within the invention.

I claim:

1. A cylindrical cutter head which comprises:

a cutter head body having a cylindrical surface which is centered on an axis and which is formed with a plurality of radially outwardly open grooves extending parallel to the axis and narrowing toward the surface of said cutter head body;

a disposable knife blade clamped in each of said grooves and having an axially extending formation;

a centrifugal wedge positioned in each of said grooves so as to provide clamping means for said knife blade;

a one piece holding bracket interposed between said knife blade and said centrifugal wedge and having a pair of unitary but relatively elastically displaceable parts one of which is engageable with the blade and has an axially extending formation complementary to and interfitting with the formation of the blade; and means fixing the other part of said bracket to said cutter head body, the bracket being elastically deformable for displacement of its one part between a normal position spaced slightly from the blade and permitting insertion and release of said knife blade and a holding position bearing on the blade and pressing same against the side of the groove, the wedge being angled and positioned such that on rotation of the body it is urged centrifugally outward and presses the one part of the bracket into the holding position.

2. The cutter head defined in claim 1 wherein the face of said disposable knife blade away from said bracket lies flush with the side wall of said groove.

3. The cutter head defined in claim 1 wherein said bracket is arranged, in the direction of motion, in front of said disposable knife blade.

4. The cutter head defined in claim 1 wherein said holding bracket is constituted by a single L-cross-section profile having one leg forming the one part and another leg forming the other part, the head further comprising screw means attaching said base strip to the floor of said groove.

5. The cutter head defined in claim 1 wherein said centrifugal wedge is self-seating.

6. The cutter head defined in claim 1 wherein said centrifugal wedge is provided with positioning screws to position said wedge at a distance from the floor of said groove.

7. The cutter head defined in claim 1 wherein said centrifugal wedge is made of a light metal.

8. The cutter head defined in claim 7 wherein said centrifugal wedge is made of aluminum.

9. The cutter head defined in claim 1 wherein said profiling of said bracket and said knife blade has side walls at an angle away from 90 degrees.

* * * * *